US006163975A

United States Patent [19]

Michelsen

[11] Patent Number: 6,163,975

[45] Date of Patent: Dec. 26, 2000

[54] COVER CLEANER HANDLE

[76] Inventor: Roger Norman Michelsen, 5245 W. Oakdale Ave., Chicago, Ill. 60641-4904

[21] Appl. No.: 09/413,779

[22] Filed: Oct. 7, 1999

[51] Int. Cl.[7] ..... F26B 17/24

[52] U.S. Cl. ..... 34/58

[58] Field of Search ..... 34/58, 312, 314, 34/318; 15/230.11, 230.12, 230.13; 134/138, 196, 900

[56] References Cited

U.S. PATENT DOCUMENTS

| | | | |
|---|---|---|---|
| 3,925,908 | 12/1975 | Dunn | 34/58 |
| 5,185,938 | 2/1993 | Hutt | 34/58 |
| 5,473,823 | 12/1995 | Powell | 34/58 |
| 5,497,527 | 3/1996 | Jang et al. | 15/230.11 |
| 5,584,092 | 12/1996 | Polzin et al. | 15/230.11 |
| 5,621,979 | 4/1997 | Taylor | 34/58 |
| 5,711,047 | 1/1998 | Armaly, Jr. | 15/230.11 |
| 5,755,004 | 5/1998 | Miller | 15/230.11 |
| 5,784,798 | 7/1998 | Taylor | 34/58 |
| 5,873,176 | 2/1999 | Richards | 34/58 |
| 6,073,362 | 6/2000 | Dean et al. | 34/58 |

*Primary Examiner*—Stephen Gravini
*Attorney, Agent, or Firm*—Patent & Trade Mark Services; Thomas Zack; Joseph H. McGlynn

[57] ABSTRACT

A retrofitted extension for mini roller covers. Conventional rotatable paint spinners are used to expel retained paint from held paint roller covers or brushes. The conventional spaced flexible arms of the paint spinner are normally used to retain either a paint roller cover on the outside of the arms or the handle of a paint brush between them. A mini roller cover adaptor has a handle which is mountable in the spinner arms normally used to hold the paint brush handle to the paint spinner. This added mini roller adaptor handle has a rod member fixed to it and a rod retaining clip. The clip retains a mini paint roller cover to the rod member. By having a rod member that is the same exact size as the inner diameter of the mini roller cover, the paint adaptor can be used with the conventional spinner to spin the min roller cover clean. This added extension to the conventional paint spinner allows for the spinner's expanded use with a much greater variety of different sized (lengths) of mini paint rollers covers while, at the same time, allowing the paint spinner to retain its intended original use by simply removing the retrofitted extension.

3 Claims, 2 Drawing Sheets

COVER CLEANER HANDLE

BACKGROUND OF THE INVENTION

This invention relates to a handle and a roller holder used in conjunction with a paint brush spinner to clean different lengths of mini paint rollers covers.

After painting is finished using a paint roller, one device that has been used to clean the paint from the roller cover is a paint spinner. This paint spinner consists of a handle and front roller grippers used to hold the roller as the handle is spun. A nearby paint absorbent surface,like a painter's cotton cloth, or paint container surrounding the roller cover allows the excess paint to be discharged from roller into the surface or container. For many standard diameter sized rollers covers this paint spinner is acceptable. However, with smaller diameter mini-sized roller covers the spinner's grippers are unable to securely hold the smaller roller during the spinning operation and therefore are not used with this smaller sized paint roller covers. The present invention is directed to a handle extension with a mini roller cover holder that can be used in conjunction with a standard sized paint spinner to permit the added spinning and the removal of paint from a mini-roller cover all as will be described in detail hereafter.

DESCRIPTION OF THE PRIOR ART

Paint roller handles and cleaning devices are known. For example, in the U.S. Pat. No. 5,497,527 to Jang et al. discloses an adjustable paint roller handle that can be used to paint horizontally, vertically or any angle between 0 and degrees.

U.S. Pat. No. 5,584,092 to Polzin et al. discloses a cage for a paint roller composed of a one piece construction with a plurality of projections on the barrel portion of the cage. These projections react with the cover's bore to keep the roller on the cage.

U.S. Pat. No. 5,711,047 to Armaly, Jr. discloses a specialty paint roller cover used to provide a rag finish.

U.S. Pat. No. 5,755,004 to Miller discloses a roller brush retainer having a retention structure for preventing a paint roller's tube brush from sliding off the roller.

SUMMARY OF THE INVENTION

This invention relates to a handle extension and a retaining means for a hand held paint applicator to be spun clean when used in conjunction with a conventional paint spinner.

It is the primary object of the present invention to provide for an improved handle and mini-roller holder that is adapted to be fitted on a paint spinner to expand its usefulness.

Another object is to provide for such a handle and mini-roller holder having a rod whose diameter is substantially the same as the inside diameter of the mini-paint roller fit on the rod.

These and other objects and advantages of the present invention will become apparent to readers from a consideration of the ensuing description and the accompanying drawings.

DESCRIPTION OF THE PREFERRED EMBODIMENT

Figure 1:
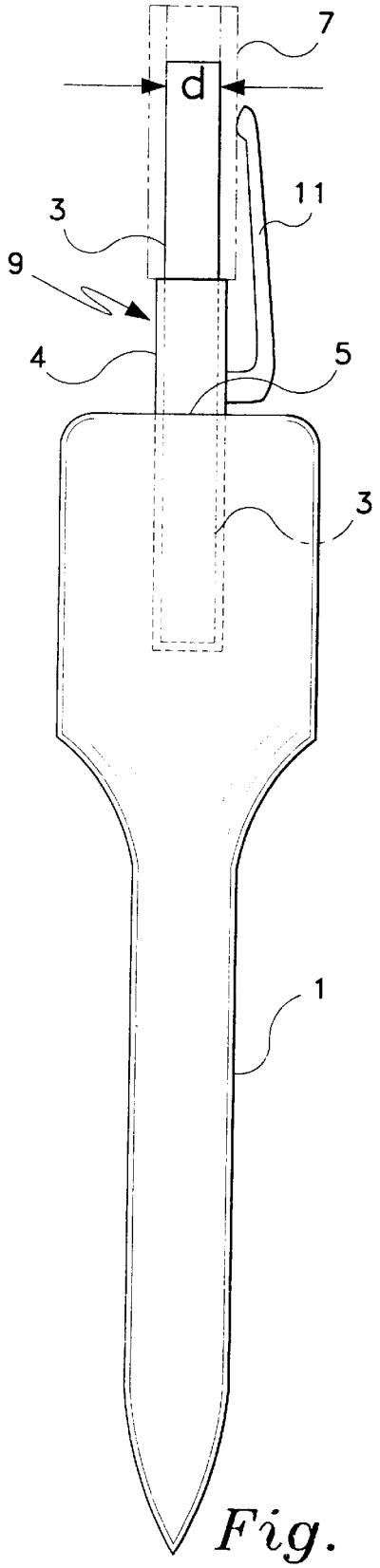
FIG. 1 is a front view of the present invention.

FIG. 1 is a front view of the present invention. The lower handle 1 has a small diameter cylindrically shaped rod 3 fixed into its top end 5 and extending into the body of the handle. In this manner, rotation of the handle 1 causes the rod 3 to rotate in unison with the handle. It is important to note that the outside diameter d of the rod 3 has been specifically selected to be substantially the same size as that of the inner diameter of a cylindrically shaped hollow interior mini-sized patent roller cover 7, shown in dotted line format. By having the same dimensions, this permits the rod 3 to be mounted snugly within the hollow length of the small mini-sized paint roller cover 7. Several well known different outer surfaced mini-sized patent rollers, generically represented by the roller cover 7, are adapted to be concentrically mounted on the rod 3 with their hollow interiors extending around the rod. These individual mini-sized paint roller covers can take on a variety of different lengths with surface textures suit to the specific job to which directed, e.g., smooth or rough surface nap, etc.

In order to insure that the mini-roller cover placed on rod 3 rotates when rotation takes place, a lower sleeve 4 with the retaining clip 9 is employed. This spring type clip, similar to those found on pens, has a portion with is mounted to the outside diameter of the sleeve 4 and also has a right angled extension 11. This extension is spaced from the rod and extends upwardly parallel to the sides of the rod 3. When a roller cover is mounted on the rod, the extension bears against the outside side of the roller cover 7 to retain the cover in place with respect to the inner rod 3.

Figure 2:
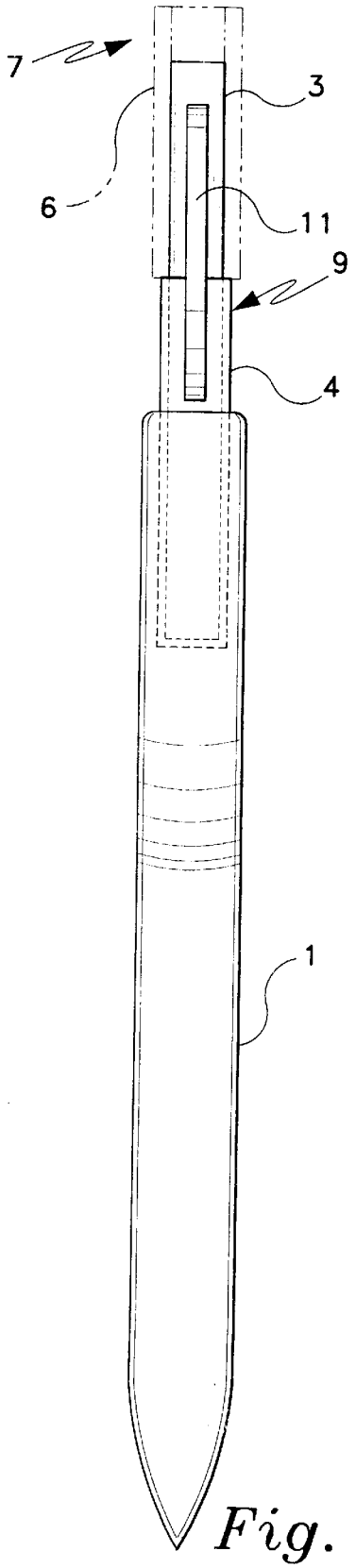
FIG. 2 is a side view of FIG. 1.

In FIG. 2, the rod 3 has the same outside diameter as the inner diameter of the mounted roller cover 7 with extension 11 shown oriented parallel to the length of rod 3 while is the sleeve's supporting outside diameter encircling portion extends slightly outwardly from the rod.

Figure 3:
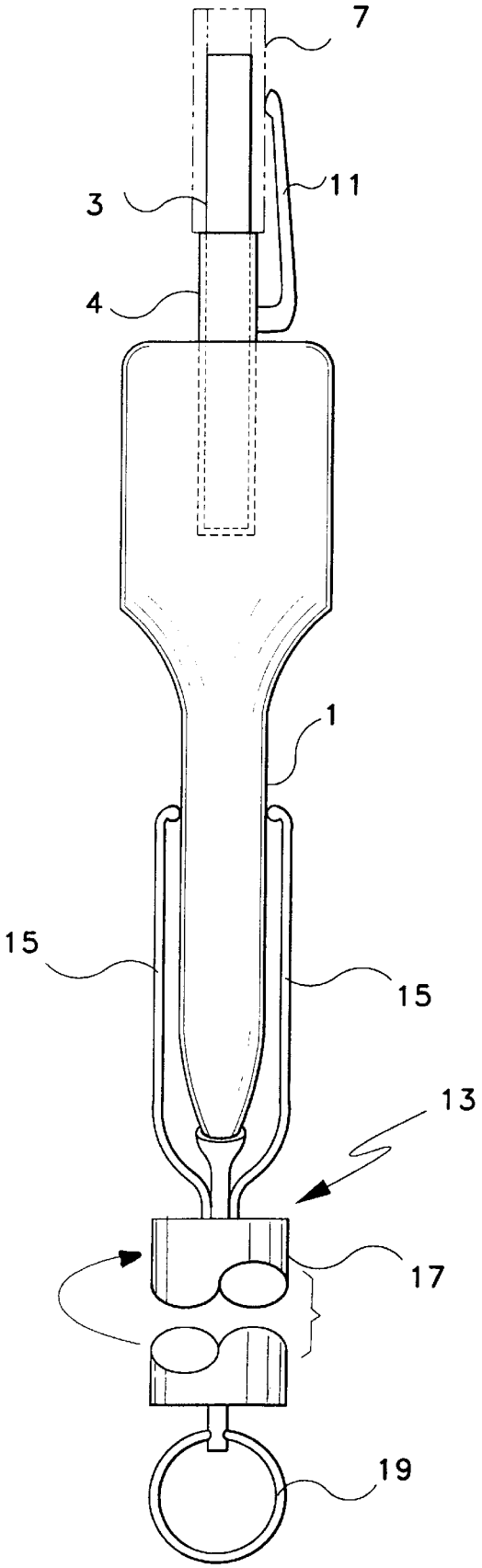
FIG. 3 is a front view of the present invention when fitted on a conventional paint spinner.

FIG. 3 is a front view of the present invention when fitted on a conventional paint spinner 13, partially shown. The paint spinner has two identical flexible holding arms 15 that are inwardly biased towards each other. These arms are spaced apart a distance which is substantially the same as the inner diameter of a standard sized conventional paint roller. This allows the standard sized paint roller (not shown) to fit over the outside of the two flexible arms 15 or, if a paint brush is used, to place the handle of the brush between the retaining arms 15. Once in place the conventional paint spinner is rotated with the arms 15 when the main body portion 17 of the spinner is rotated by the lower end handle 19. A paint absorbing surface, such as a towel or painter's cloth, can be placed around the arms with the roller/brush's bristles between them to absorb the paint that is released by the roller in the spinning operation. Alternatively, the expelled paint can be deposited into a paint container, placed around the roller or brush's bristles, for reuse or expenditure.

In place of the standard sized paint roller, the present invention uses the previously described refitted handle 1 having substantially the same outer diameter as the paint brush handle. Thus, the handle 1 and its attached smaller diameter roller 3 is a retrofit for use with a standard sized conventional paint spinner allowing this spinner's use to be expanded to include the spinning of mini-sized smaller diameter rollers in addition to those larger diameters rollers the spinner 13 previously was used to spin clean. It is to be noted that the mini roller covers of this invention are mounted not on outside of the spinner's arms but to a roller whose handle is mounted within the spinner's arms.

Clearly, the retrofitted paint roller cover could also be placed within the confines of paint container if the reuse of the paint expelled from it was desired.

The handle 1 and its rod 3 thus forms a retrofit that can be used an extension for a conventional paint spinner 13. The retrofit's handle 1 is used in the same matter as a conventional paint brush handle with the spinner, once in place, to expel paint for the held mini roller cover retained by clip 9. Should it be desired to use the conventional paint spinner to dispel paint for a larger paint roller cover or a paint brush, this can easily be an done by removing the retrofitted handle 1 from the spinner's arms.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A paint spinner mountable retaining device for a paint depositing hand held implement comprising:

a first retaining means with extending spaced apart arms usable to retain a paint depositing hand held implement;

a mini roller cover cleaner adaptor having a handle with a length, said handle being retainable between the arms of said first retaining means, said mini roller cover cleaner adaptor also having a rod member with a length, said rod member being fixed to the handle of the adaptor, the length of said rod member extending in the same direction as the length of said handle; and second retaining means for a paint depositing hand held implement mounted on said rod member whereby the handle of said cover cleaner adaptor may be retained and rotated in unison with the arms of the first retaining means to dispel paint from a held implement.

2. The combination as claimed in claim 1, wherein the rod member has a given diameter, and the paint depositing hand held implement held by the first retaining means is a cylindrically shaped paint roller cover, said roller cover having an inner diameter less than the distance the arms of the paint spinner are spaced apart and substantially the same as the given diameter of said rod member.

3. The combination as claimed in claim 2, wherein said second retaining means is a flexible clip mounted to rotate with said rod member, said clip having an extension extending in the same direction as the length of said rod member to retain the roller cover to the rod member.

* * * * *